US005606222A

United States Patent [19]

Cottaar et al.

[11] Patent Number: 5,606,222

[45] Date of Patent: Feb. 25, 1997

[54] LIGHTING SYSTEM WITH A DEVICE FOR REDUCING SYSTEM WATTAGE

[75] Inventors: Eduardus J. Cottaar, Hammondsport, N.Y.; Dirk Van Pijkeren, Waalre, Netherlands

[73] Assignee: Philips Electronics North America Corporation, New York, N.Y.

[21] Appl. No.: 366,137

[22] Filed: Dec. 29, 1994

[51] Int. Cl.[6] ..... H01J 7/44

[52] U.S. Cl. ..... 315/58; 315/73; 315/289; 315/241 R; 315/291

[58] Field of Search ..... 315/239, 246, 315/241 R, 283, 291, DIG. 5, 289, 58, 73, 56, 209 R, 187, 96

[56] References Cited

U.S. PATENT DOCUMENTS

| | | | |
|---|---|---|---|
| 3,889,152 | 6/1975 | Bodine, Jr. et al. | 315/205 |
| 3,919,592 | 11/1975 | Gray | 315/199 |
| 3,925,705 | 12/1975 | Elms et al. | 315/246 |
| 3,929,992 | 12/1975 | Sehgal et al. | 424/122 |
| 3,954,316 | 5/1976 | Luchetta | 315/187 |
| 3,975,660 | 8/1976 | Knobel et al. | 315/102 |
| 3,987,339 | 10/1976 | Wroblewski | 315/278 |
| 4,134,042 | 1/1979 | Van Heemskerck Veeckens | 315/59 |
| 4,163,176 | 7/1979 | Cohen et al. | 315/53 |
| 4,275,337 | 6/1981 | Knoble et al. | 315/289 |
| 4,331,905 | 5/1982 | Owen | 315/225 |
| 4,501,994 | 2/1985 | Spreadbury | 315/307 |
| 4,553,070 | 11/1985 | Sairanen et al. | 315/209 R |
| 4,609,849 | 9/1986 | French | 315/200 R |
| 4,613,792 | 9/1986 | Kroessler | 315/97 |
| 4,780,649 | 10/1988 | Scholz et al. | 315/326 |
| 4,795,945 | 1/1989 | Mayer | 315/276 |
| 5,122,714 | 6/1992 | Chermin et al. | 315/289 |
| 5,185,557 | 2/1993 | Luijks et al. | 315/73 X |
| 5,325,017 | 6/1994 | Schellen et al. | 315/58 |
| 5,336,974 | 8/1994 | Luijks et al. | 315/58 |
| 5,343,120 | 8/1994 | Mulieri | 315/58 |

FOREIGN PATENT DOCUMENTS

| | | |
|---|---|---|
| 2486754 | 1/1982 | France . |
| 3736324A1 | 5/1989 | Germany . |
| 1011991 | 4/1964 | United Kingdom . |

*Primary Examiner*—Robert Pascal
*Assistant Examiner*—Haissa Philogene
*Attorney, Agent, or Firm*—Brian J. Wieghaus

[57] ABSTRACT

A lighting system having a gas discharge lamp and a stabilization ballast further includes a low loss device to reduce the current through the ballast and lamp, thereby reducing system wattage for energy savings. For a lead-type ballast, the current reducing device is a capacitive device in parallel with the discharge lamp. For a lag-type ballast, the device is an inductive device in parallel with the lamp. The device may be in a housing connected between the lamp ballast and the lamp, or may be included within the outer envelope of the discharge lamp. This enables an existing system to be easily retrofit without disturbing the existing ballast.

15 Claims, 2 Drawing Sheets

LIGHTING SYSTEM WITH A DEVICE FOR REDUCING SYSTEM WATTAGE

BACKGROUND OF THE INVENTION

1) Field of the Invention

The invention relates to lighting systems and, more particularly, to a device for reducing system wattage in gas discharge lamp lighting systems.

2) Description of the Prior Art

High pressure gas discharge (HID) lamps are widely used for industrial and shop lighting, among others. HID lamps are lamps which have a discharge vessel, for example of quartz or ceramic, which have a filling that supports a discharge arc at a gas pressure during operation generally at above about 2 atmospheres. High pressure sodium (HPS), high pressure mercury vapor and metal halide lamps are within the group known as HID lamps.

HID lamps, as with low pressure gas discharge lamps such as fluorescent lamps, have a negative resistance characteristic and require a stabilization ballast to control the current through the lamp during lamp operation. Without a ballast, the lamp current would increase rapidly and uncontrollably after lamp ignition, leading to failure of the lamp. The simplest ballast is a choke coil placed in series with the lamp and having an impedance chosen in accordance with the operating voltage of the lamp type for which it is designed to maintain the lamp current at the desired level. Such a ballast has an undesirably low and lagging power factor (current lagging the voltage). To improve the power factor, and also to reduce the starting current, a capacitor is placed in parallel with the choke coil. In the United States, ballasts used for HID lamps typically have a leading power factor (current leading the voltage) provided by a capacitor in series with the inductor. The above are the simplest ballast topographies. A very common ballast in commercial use for HID lamps is the constant-wattage autotransformer (CWA), which provides power stability despite common fluctuations in the mains voltage. This ballast includes a high reactance autotransformer (a transformer so connected that part of its winding is common to both the secondary and the primary) and a capacitor in series with the lamp, and provides a leading power factor.

Lighting accounts for approximately 20–25% of the electricity used in the United States. For stores, offices and warehouses, lighting may account for up to 50% of their electrical consumption. Accordingly, energy saving in lighting systems can provide a substantial savings in total energy usage for such commercial establishments.

Commercial HID lighting installations employ luminares dispersed throughout the area to be illuminated. A luminaire is a complete lighting unit which physically supports the ballast and its housing, the lamp socket and the lamp, and often a reflector to direct the light from the lamp. One way of achieving improved energy efficiency is to replace existing installations with new luminares having more efficient lamps and ballasts. For example, replacing luminares having a conventional mercury vapor lamp and CWA ballast with a luminaire having an HPS lamp and ballast designed for the HPS lamp will provide greater system efficacy. The disadvantage with this approach is the high initial capital cost.

Another approach is to replace only the lamp in the luminares with a more efficient lamp, which is a much lower cost alternative because the existing ballast and other luminaire components are retained. The lamp may be of a different type than that replaced. For example, it is common to replace mercury vapor lamps with HPS lamps, which have a higher efficacy than mercury vapor lamps of similar wattage and can operate on the same ballast. The new lamps may also be of the same type as that replaced, but modified to use less energy with the existing ballast. For example, one energy saving approach is to replace HPS lamps of one rated lamp voltage with HPS lamps of a lower rated lamp voltage. Generally, a decrease in rated lamp voltage of about 20% results in a lamp wattage decrease of about 10% when used with a CWA ballast.

While reducing lamp voltage results in energy savings, it has the disadvantage that the current through the lamp and ballast goes up. This causes higher ballast losses than with the original lamp and results in a considerably smaller decrease in system wattage than in lamp wattage. For a decreased lamp voltage of about 20%, the system wattage only decreases by about 5–7% for a decrease in lamp wattage of about 95%.

Accordingly, it is the object of the invention to decrease system wattage in retrofit gas discharge applications, i.e. without changing the existing ballast.

SUMMARY OF THE INVENTION

Generally speaking, the lighting system according to the invention includes a gas discharge lamp, a ballast for controlling the current through the lamp during lamp operation, and a current reducing device connected between the ballast and the discharge vessel of the lamp for reducing the current through the lamp during lamp operation, which device has lower electrical losses than either the lamp discharge vessel or the ballast. By reducing the current through the lamp and the ballast to reduce lamp wattage, the losses in the ballast are reduced as compared to the situation where only the rated lamp voltage of the retrofit lamp is reduced. When the rated lamp voltage is kept the same in spite of the lower lamp wattage, the reduction in lamp wattage and system wattage is then substantially the same. To achieve the greatest energy savings, the device preferably has substantially no losses.

Favorably, the current reducing device is connected in parallel with the discharge vessel. To take a substantial amount of the current, the impedance of the parallel connected device should be between about ten (10) to about twenty (20) times higher than the impedance of the discharge vessel of the discharge lamp. This has the advantage that the device carries a much smaller fraction of the current than if it were in series with the lamp, and therefore the losses will be much lower because losses are proportional to the square of the current.

In an embodiment for use with lead-type ballasts, the current reducing device includes a capacitive device connected electrically in parallel with the discharge lamp. Favorably, the capacitive device is a capacitor component, which has very low losses. The capacitor may be included in a housing or "can" with lead wires extending therefrom. This capacitor "can" may then be arranged in the luminaire external to the lamp and the existing ballast for electrical connection to the lamp socket and the ballast leads. While this requires some labor, the existing ballast is still used. Alternatively, the capacitor may be included in the discharge lamp, for example enclosed within the outer envelope or between the lamp envelope and the lamp cap, if space permits. This has the significant advantage that a lighting system may be very easily retrofit merely by removing the existing lamps and by installing the new lamps incorporating the parallel capacitor. Thus, the cost of wiring an extra component into the luminaire is avoided.

Another embodiment of the invention includes an inductive device in series with the parallel capacitive device. In systems in which a pulse ignitor is used which provides a high frequency (>>1 kHZ) start pulse, the parallel capacitive device may decrease the height of the ignition pulse and interfere with proper lamp ignition. This may occur with certain combinations of ballasts and capacitor components. The series inductive device is tuned to block the high frequency ignition pulse, ensuring that the parallel capacitor does not reduce the starting pulse enough to interfere with proper lamp starting. After ignition, the inductive device will not interfere with the function of the capacitive device due to the much lower mains frequency (50/60 Hz) of the ballast. In an embodiment, the inductive means includes a ferrite body in the form of a bead on the capacitor leads. Alternatively, a switch may be used to disconnect the parallel capacitor during lamp ignition and connect the parallel capacitor after ignition.

In another embodiment of the invention, for use with lag-type ballasts, the current reducing device includes an inductive device connected in parallel with the discharge lamp.

It should be noted that the energy saving capability provided by the above embodiments was surprising in view of the reference FR-A-2,480,649. The FR '649 discloses an arrangement to dim a high pressure mercury vapor lamp to 50% power level with a lag-type ballast (having a capacitor in parallel with the inductor). Dimming to this level with this ballast was problematic due to an insufficient reignition voltage at each half cycle, which would cause the lamp to extinguish. An additional capacitor placed in parallel with the lamp was found to increase the reignition voltage at each half-cycle sufficient to avoid extinguishment of the lamp. However, the '649 reference teaches that this arrangement actually increases the system wattage from about 275 W to about 295 W for a 250 W lamp. The lamp is effectively dimmed, but energy usage increases! The FR '649 arrangement was replicated by the present applicants, and the increase in system wattage was confirmed.

The objective of the present invention is not dimming per se (though this may occur), but energy savings in existing installations while maintaining the same or similar light levels. To this end, applicants have discovered that energy savings is accomplished for lead-type ballasts with a capacitive device in parallel with the lamp and for lag-type ballasts with an inductive device in parallel with the lamp.

These and other embodiments, features and advantages of the invention will become apparent with reference to the following drawing, detailed description and appended claims.

DESCRIPTION OF THE PREFERRED EMBODIMENTS

Figure 1A:
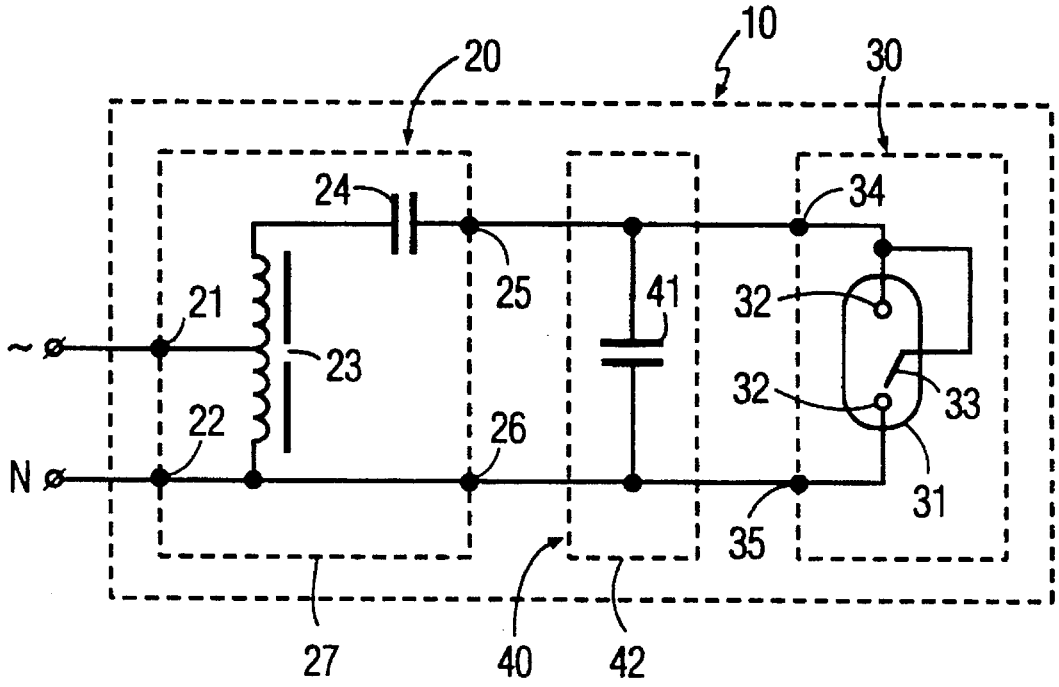
FIG. 1*a* is a schematic diagram of a luminaire with a lead-type ballast with an HID lamp and a parallel capacitive device.
Figure 1B:
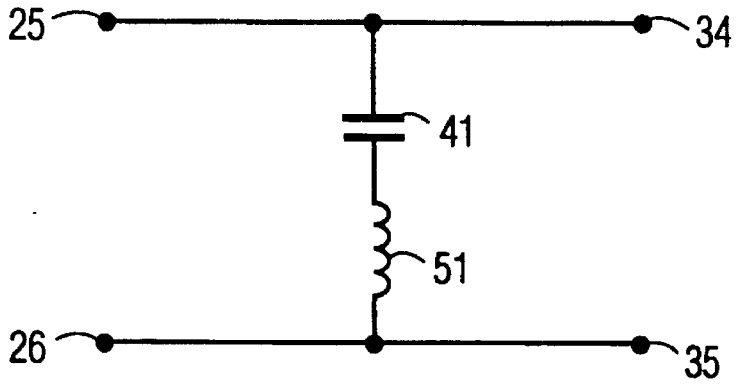
FIG. 1*b* is a schematic of a portion of FIG. 1*a* showing an inductive device in series with the capacitor.

FIG. 1 schematically illustrates a luminaire 10 which includes a lead-type ballast 20, an HID lamp 30, and capacitive device 40. The lead-type ballast 20 is a CWA ballast having a pair of input terminals 21, 22 for connection to the mains supply, a high reactance autotransformer 23, and a ballast capacitor 24. The ballast further includes a pair of output terminals 25, 26. The autotransformer includes a laminated iron core and a winding which is common to both the primary and secondary sides of the ballast. The ballast is enclosed in a conventional ballast housing 27, represented by dashed lines. Connected across the ballasts outputs 25, 26 is the HID lamp 30. In the figure, the HID lamp is a high pressure mercury lamp having a discharge vessel including a quartz glass arc tube 31, a pair of discharge electrodes 32, a starting electrode 33, and a filling comprised of mercury and a rare gas within the arc tube 31 which supports an arc discharge between the electrodes 32 during lamp operation. The discharge vessel is typically enclosed in an outer envelope (not shown) carrying a lamp base (such as a Mogul base) carrying the lamp terminals 34, 35. The ballast 20 and lamp 30 represent the typical components within the housing of a high pressure mercury lamp luminaire.

In order to decrease energy consumption, a capacitive device 40 is retrofit into the luminaire. In the figure, the capacitive device is a capacitor component 41 enclosed in a protective housing or "can" represented by dashed lines 42. The capacitive device 40 is connected electrically in parallel with the discharge lamp 30 and serves to reduce the lamp current during lamp operation. To accomplish this, the impedance of the capacitor typically has a value which is about ten (10) to twenty (20) times higher than the impedance of the lamp 30.

The combination of the existing lamp and retrofit (parallel) capacitor provides a greater impedance to the ballast than the existing lamp alone. Consequently, the current through the ballast is reduced with the retrofit capacitor, and consequently the ballast losses are reduced. Additionally, the parallel capacitor takes some of the system current, so the lamp current and power are reduced. The capacitor 41 has very low losses as compared to the ballast 20 and the lamp 30. Thus, the capacitor 41 reduces the power dissipated by the lamp and ballast to a much greater extent than the extra losses provided by the additional capacitor 41, so total system energy decreases. In the above situation, a reduced light output accompanies the reduced power consumption since the lamp used was not changed.

As previously discussed, it is common to replace the mercury lamps in existing installations with the more efficient HPS lamps. Accordingly, tests were conducted using the parallel capacitor 41 with HPS lamps. The tests were conducted using an Advance 71A4822 400 W ballast lamp and an Advance 71A8221 250 W ballast. The results are indicated in Table I below. Instead of using lamps nominally rated at 400 W and 250 W for operation on the above-ballasts, the test lamps used arc tubes modified to provide the same lamp voltage as the control lamps (100–105 V) when used with the listed parallel capacitor, Changing the lamp wattage/voltage can be done in many ways, including changing the interelectrode distance, for example. The control case for each test (without the capacitor 41) is indicated in the table by the capacitance of 0.0 mfd. Standard lamps were used for the control, i.e., normally having the listed lamp voltage for the described ballast (without a parallel capacitor).

TABLE I

| type | C mfd | Vla V | Ila A | Wla W | Wlar % | Vsys V | Isys A | Wsys W | Wsysr % | P.F. Sys |
|---|---|---|---|---|---|---|---|---|---|---|
| 400 | 0.0 | 102 | 4.60 | 384 | 100 | 239 | 1.91 | 448 | 100 | 0.98 |
| 400 | 2.0 | 102 | 4.15 | 355 | 92 | 239 | 1.77 | 411 | 92 | 0.97 |
| 400 | 3.0 | 102 | 4.06 | 347 | 90 | 239 | 1.73 | 403 | 90 | 0.97 |
| 250 | 0.0 | 104 | 3.24 | 279 | 100 | 240 | 1.37 | 327 | 100 | 0.99 |
| 250 | 1.5 | 107 | 2.91 | 265 | 95 | 240 | 1.29 | 306 | 94 | 0.99 |
| 250 | 3.0 | 105 | 2.84 | 253 | 91 | 240 | 1.23 | 293 | 90 | 0.99 |

In the above tests, the lamp voltage for the test lamps remained substantially the same as for the control lamps despite the decrease in lamp current caused by the presence of the parallel capacitor 41. For the 400 W test, the lamp voltage remained the same (102 V) for each capacitance while for the 250 W test the lamp voltage was very close to the control. It can be seen that the percent decrease in system wattage and in lamp wattage is identical for the 400 W case and is substantially the same for the 250 W.

The above illustrates how system and lamp wattage can be equally reduced by using a retrofit lamp which will have the same lamp voltage (when used with the intended parallel capacitor) as the HPS or mercury lamp replaced. However, significant energy savings can be obtained even where the lamp voltage is reduced in the presence of the retrofit (parallel) capacitor. This is illustrated in Table II below.

TABLE II

| type | C mfd | Vla V | Ila A | Wla W | Wlar % | Vsys V | Isys A | Wsys W | Wsysr % | P.F. Sys |
|---|---|---|---|---|---|---|---|---|---|---|
| 400 | 0 | 102 | 4.6 | 384 | 100 | 239 | 1.9 | 448 | 100 | 0.98 |
| 400 | 2 | 93 | 4.55 | 352 | 92 | 240 | 1.76 | 416 | 93 | 0.98 |
| 400 | 3 | 91 | 4.55 | 343 | 89 | 239 | 1.72 | 407 | 91 | 0.99 |
| 250 | 0 | 104 | 3.2 | 279 | 100 | 240 | 1.4 | 327 | 100 | 0.99 |
| 250 | 2 | 89 | 3.23 | 240 | 86 | 240 | 1.21 | 286 | 87 | 0.98 |
| 250 | 3 | 87 | 3.18 | 231 | 83 | 240 | 1.16 | 276 | 84 | 0.99 |

As compared to Table I, it is seen in Table II that the lamp voltages for both the 400 W and 250 W tests did not remain the same but were substantially reduced with increasing capacitance (due to decreasing lamp current) as compared to the control lamps. For the 400 W test, the decrease in system wattage was comparable to that in Table I, whereas the decrease in system wattage was actually lower for the 250 W test. The lower system wattage for the 250 W case provided lower lumens than the corresponding case in Table I, however, because the resulting lamp wattages were significantly lower.

It should also be observed that in both Tables I and II, the system power factor remains substantially the same for the test cases as compared to the control. Thus, no other losses are introduced and the energy savings is real.

The typical impedance of various wattage HPS lamps (make Philips Lighting Company) are summarized in Table III below along with values of capacitance to providing an expected manimum system energy savings on the order of about 40%.

TABLE III

| Wla (W) | Vla (V) | Ila (I) | Z (Ohm) | C (mfd) |
|---|---|---|---|---|
| 35 | 55 | 0.75 | 73.46 | 4 |
| 50 | 55 | 1.07 | 51.43 | 5 |
| 70 | 55 | 1.50 | 36.73 | 7 |
| 100 | 55 | 2.14 | 25.71 | 10 |
| 150 | 55 | 3.21 | 17.14 | 15 |
| 150 | 100 | 1.76 | 56.67 | 5 |
| 250 | 100 | 2.94 | 34.00 | 8 |
| 400 | 100 | 4.71 | 21.25 | 12 |
| 1000 | 275 | 4.28 | 64.28 | 4 |

In some situations, particularly for HPS lamps which require an ignition pulse on the order of several KV (typically generated by a high frequency starter of >>1KHz), the parallel capacitor may reduce the ignition pulse sufficiently to cause ignition difficulties. In this situation, an inductor 51 placed in series with capacitor 41 (see FIG. 1*b*) is tuned to block the high frequency starting pulse but pass the low frequency mains current after ignition so that the capacitor 41 properly reduces lamp and ballast current. However, many capacitors will have a relatively high inductance by themselves, because of the coiled plate structure, so an additional inductor is unnecessary. Such capacitors will act as a capacitor at 60 Hz but act as a coil at high frequency and not decrease the starting pulse.

As noted previously, HPS lamps have a higher efficacy than mercury vapor lamps and can operate on existing CWA mercury ballasts. To reduce energy consumption in lighting systems with such ballasts, HPS lamps have been substituted for the mercury vapor lamps. The substituted HPS lamps generally have a lamp voltage and wattage the same as the mercury lamp it replaced. This provides an energy savings of about 10%, due to the lower lamp factor for an HPS lamp (0.93–0.95) than a mercury lamp (0.97–0.98), resulting in less energy transferred to the HPS lamp than the mercury lamp. (The lamp factor is a measure of the phase of the lamp current relative to lamp voltage, similar to the ballast power factor). While this provides reduced energy consumption, it also provides significantly more light (by about 40%) than that provided by the mercury vapor lamps because HPS lamps have about twice the efficacy (LPW) of mercury lamps. The extra light represents wasted energy. Accordingly, it is desirable to provide a retrofit system in which HPS lamps are used but in which the light output is substantially the same as that originally provided by the mercury lamps. This is accomplished in another embodiment by the combination of a parallel capacitor and an HPS lamp, the combination of which is optimized to provide the same light output as the replaced mercury lamps when operated on the CWA mercury ballast. Suitable values for the capacitance of the parallel capacitor for an HPS-mercury lamp retrofit are generally on the order of twice that shown in Table III.

An example of how the same lumens can be obtained by retrofitting a mercury lamp with a retrofit kit consisting of an HPS lamp and parallel capacitor is as follows. The existing installation has a 175 W CWA mercury ballast with a 175 W mercury lamp. Such a lamp has a nominal arc (lamp) voltage of 130 V, a lamp factor of about 0.97, an efficacy of about 52 LPW and provides about 9000 lumens. The lamp current is about 1.3–1.5 amps. A suitable HPS lamp for retrofit is a 100 W HPS lamp having a 100 V arc voltage, with a typical lamp factor of 0.93. With a parallel capacitor taking up about 20% of the system current, the lamp current will be about 1.2 amps. In effect, the parallel capacitor and the retrofit HPS lamp have substantially the same impedance as that of the mercury lamp it replaced. The current through the ballast is therefore about the same as with the mercury lamp, so there are no additional ballast losses. However, the lumen level will be about the same (9000 lumens), with the system energy consumption reduced by 75 W due to the reduction in power by the retrofit HPS. This is a 43% energy savings.

In the embodiment shown in FIG. 1, the capacitor is enclosed in a capacitor "can" which is separately wired into the luminaire. In the situation where an HPS lamp is to be retrofit for an existing mercury lamp, this "can" may be provided to the customer with the retrofit HPS lamp as a kit. Additionally, depending on the physical size of the capacitor chosen and the space available within the outer lamp envelope (regardless of HID lamp type), the capacitor may be included within the lamp envelope. It should be noted that for the case of Table I where an HPS lamp is provided with an arc tube which will have the same lamp voltage about (100 V) with the parallel capacitor, this may be accomplished with an arc tube of comparatively smaller length, allowing more room for the capacitor within the lamp envelope.

Figure 2:
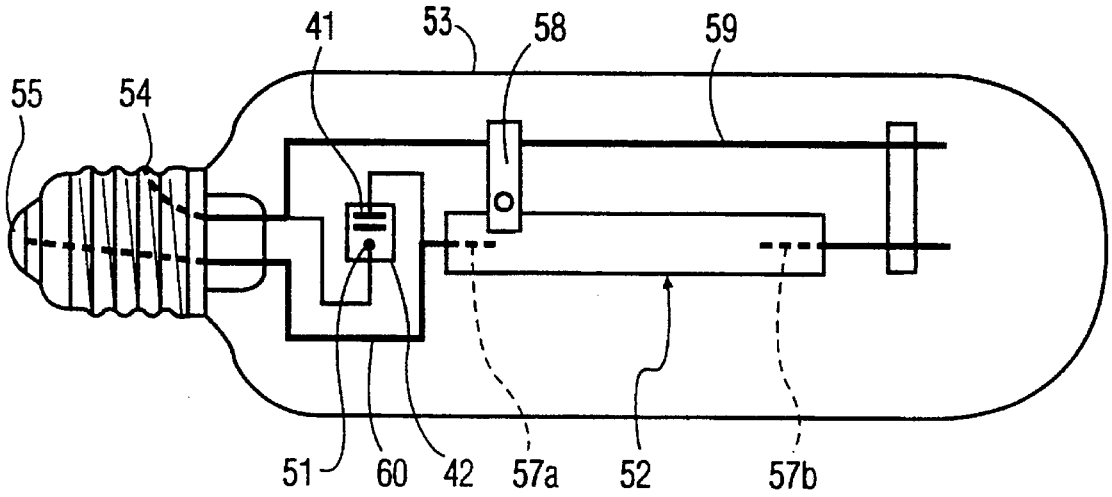
FIG. 2 illustrates an HPS lamp with a capacitor within the outer envelope enclosed in gas-tight glass capsule.

FIG. 2 illustrates the capacitor within an HPS lamp having an outer envelope 53 enclosing a ceramic discharge vessel 52 in a conventional manner. The discharge vessel includes a pair of discharge electrodes 57*a, b* and an arc discharge sustaining filling of mercury, sodium metal and a rare gas, as is conventional. Frame conductors 59, 60 support the discharge vessel and electrically connect the electrodes 57 to respective ones of the lamp cap contacts 54, 55. Bimetal 58 serves as an ignition aid to induce ionization in the fill. It is connected with the conductor 59 and is closed against the discharge vessel in the cold state adjacent the electrode 57*a*, which is of the opposite potential. The capacitor 41 is connected electrically in parallel with the discharge vessel between frame conductors 59, 60. A series inductor includes a ferrite bead 51 on the capacitor leads for the reasons previously discussed. To protect the capacitor and ferrite bead within the high temperature lamp environment and also to prevent outgassing from the capacitor into the evacuated lamp envelope, the capacitor is enclosed within a gas-tight glass capsule within the outer lamp envelope. It should be noted that the use of such a capsule, at least for a capacitor as part of a starting circuit, is known from U.S. Pat. No. 5,336,974. Additionally, where the parallel capacitor should be removed from the circuit to ensure a proper ignition, a bimetal switch may be used which connects the capacitor 41 in parallel with the discharge vessel when heated by the discharge vessel after ignition.

Figure 3:
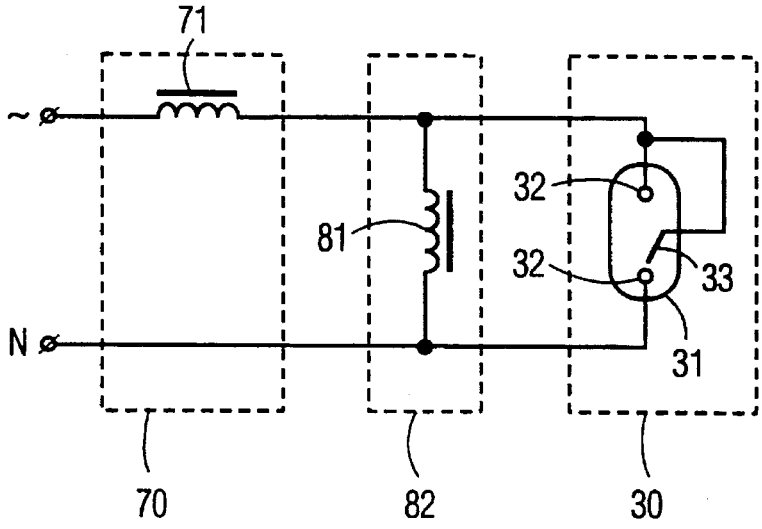
FIG. 3 is a schematic diagram of a lag-type ballast with an HID lamp and a parallel inductive device according to the invention.

FIG. 3 shows an embodiment of the invention with a lag-type ballast 70 including choke 71. Instead of a parallel capacitor, an inductive device in parallel with the discharge lamp 30 reduces the current through the lamp and ballast. The inductive device is a separate choke 81 enclosed in a housing 82 and wired in series with the discharge lamp 30. As with the parallel capacitor for a lead-ballast, the inductive device should have an impedance of 10–20 times that of the discharge lamp.

Those of ordinary skill in the art will appreciate that various modifications may be made to the above-described embodiments which are within the scope of the appended claims. For that purpose, the above description is to be understood to be illustrative only, and not limiting.

We claim:

1. A lighting system comprising a high pressure gas discharge lamp and ballast for controlling the lamp current through said lamp, characterized by further comprising:

a device external to said ballast for reducing current through said lamp during normal lamp operation, said device having lower power dissipation than said ballast and said lamp during system operation and said device having an impedance during normal lamp operation that is between about ten and twenty times higher than the impedance of the lamp during normal lamp operation.

2. A lighting system according to claim 1, wherein said device is electrically in parallel with said lamp.

3. A lighting system according to claim 2, wherein said ballast is a lead-type ballast in which the lamp current leads the lamp voltage in phase, and said device comprises capacitive means for exhibiting capacitive characteristics.

4. A lighting system according to claim 2, wherein said ballast is a lag-type ballast in which the lamp current lags the lamp voltage in phase, and said device comprises inductive means for exhibiting conductive characteristics connected electrically in parallel with said gas discharge lamp.

5. A lighting system according to claim 3 in which the capacitive means has a capacitance on the order of 1.5–15 mfd.

6. A lighting system comprising a gas discharge lamp and ballast for controlling the lamp current through said lamp, characterized by further comprising:

a capacitive means external to said ballast and Connected electrically in parallel with said lamp for exhibiting capacitive characteristics and reducing current through said lamp during normal lamp operation, said capacitive means having lower power dissipation than said ballast and said lamp during system operation and said ballast being a lead-type ballast in which the lamp current leads the lamp voltage in phase, wherein said system further comprises (i) ignitor means for providing an ignition voltage pulse at high frequency for igniting said gas discharge lamp, and (ii) inductive means for exhibiting inductive characteristics, said inductive means being connected in series with said capacitive means and being selected for blocking said ignition pulse.

7. A lighting system according to claim 6, wherein said capacitive means comprises a capacitor component, and said inductive means comprises electrically conductive connection leads connected to said capacitor.

8. A lighting system according to claim 7, wherein said inductive means further comprises a body of ferrite material in said connection leads.

9. A high pressure gas discharge lamp lighting system, comprising:

a) a high pressure gas discharge lamp;

b) a lead-type ballast for controlling the electric current through said gas discharge lamp during lamp operation with the lamp current leading the lamp voltage in phase;

c) capacitive means for exhibiting capacitive characteristics arranged external to said ballast, said capacitive means being connected electrically in parallel with said gas discharge lamp for reducing current through said lamp and ballast during normal lamp operation; and d) inductive means connected in series with said capacitive means.

10. A lighting system according to claim 9, wherein said gas discharge lamp includes an outer envelope sealed in a gas-tight manner and a discharge vessel disposed within said outer envelope, and said capacitive means is disposed within said outer envelope.

11. A lighting system according to claim 10, wherein said capacitive means is a capacitor component, and said lamp further comprises a capsule enclosing said capacitor in a gas-tight manner.

12. A lighting system according to claim 9, wherein said inductive means comprises a ferrite bead connected electrically in series with said capacitive means.

13. A lighting system according to claim 9, wherein said gas discharge lamp includes an outer envelope sealed in a gas-tight manner and a discharge vessel disposed within said outer envelope, and said capacitive means is disposed outside of said outer envelope.

14. A lighting system according to claim 13, further comprising a first housing enclosing said capacitive means and a second housing enclosing said ballast.

15. A method for reducing the system wattage of a mercury vapor lamp system comprising a mercury vapor lamp ballast and mercury vapor lamp without reducing light output, comprising the steps of:

replacing the mercury vapor lamp with a high pressure sodium lamp having a lower rated wattage than the mercury vapor lamp but not a lower light output at the lower rated wattage;

connecting a capacitor in parallel with the high pressure sodium lamp, the capacitor having an impedance during normal operation that is on the order of 10 to 20 times the impedance of the high pressure sodium lamp during normal operation; and powering the high pressure sodium lamp and parallel connected capacitor with the mercury vapor lamp ballast.

* * * * *